US005956874A

United States Patent [19]

Ianello et al.

[11] Patent Number: 5,956,874

[45] Date of Patent: Sep. 28, 1999

[54] TOOTH ASSEMBLY AND LOCK SYSTEM

[75] Inventors: Garrick J. Ianello, Portland; Michael D. Moehnke, Forest Grove, both of Oreg.

[73] Assignee: Columbia Steel Casting Co., Inc., Portland, Oreg.

[21] Appl. No.: 09/074,631

[22] Filed: May 7, 1998

[51] Int. Cl.[6] ..... E02F 9/28

[52] U.S. Cl. ..... 37/456; 172/772.5

[58] Field of Search ..... 37/456, 455, 452; 172/772, 772.5

[56] References Cited

U.S. PATENT DOCUMENTS

| | | | |
|---|---|---|---|
| 2,688,475 | 9/1954 | Small | 262/8 |
| 2,904,908 | 9/1959 | Ratkowski | 37/142 |
| 3,085,635 | 4/1963 | Livermore | 172/699 |
| 3,358,569 | 12/1967 | Averette | 94/50 |
| 3,601,911 | 8/1971 | Wood | 37/142 R |
| 3,894,349 | 7/1975 | Moreau | 37/142 A |
| 3,897,642 | 8/1975 | Helton et al. | 37/142 R |
| 3,959,901 | 6/1976 | Klett | 37/141 R |
| 4,136,469 | 1/1979 | Zepf | 37/141 T |
| 4,414,764 | 11/1983 | Johansson et al. | 37/141 T |
| 4,428,131 | 1/1984 | Hahn | 37/142 R |
| 4,455,771 | 6/1984 | Poncin | 37/142 A |
| 4,782,607 | 11/1988 | Frisbee et al. | 37/141 T |
| 4,823,486 | 4/1989 | Diekevers et al. | 37/142 R |
| 4,848,013 | 7/1989 | Bowman et al. | 37/142 A |
| 4,872,274 | 10/1989 | Giersch et al. | 37/64 |
| 4,918,843 | 4/1990 | Kiesewetter et al. | 37/142 A |
| 5,052,134 | 10/1991 | Bierwith | 37/142 A |
| 5,077,918 | 1/1992 | Garman | 37/141 T |
| 5,172,500 | 12/1992 | Renski et al. | 37/142 A |
| 5,205,057 | 4/1993 | Garman | 37/458 |
| 5,272,824 | 12/1993 | Cornelius | 37/142 A |
| 5,412,885 | 5/1995 | Cornelius | 37/451 |
| 5,435,084 | 7/1995 | Immel | 37/398 |
| 5,579,594 | 12/1996 | Pasqualini et al. | 37/455 |

*Primary Examiner*—Christopher J. Novosad
*Attorney, Agent, or Firm*—Klarquist Sparkman Campbell Leigh & Whinston LLP

[57] ABSTRACT

A lock system removably connects an earth-engaging tooth point to an adapter. The forward-extending nose of the adapter fits within the rear-facing socket of the tooth point. A pair of opposing sides of the socket defines coaxial apertures. The adaptor has a hole through opposing sides. A locking pin is inserted into the apertures and the hole, thus fixedly connecting the tooth point to the adapter. The locking pin is retained by a keeper situated in an annular groove within one of the apertures.

10 Claims, 2 Drawing Sheets

TOOTH ASSEMBLY AND LOCK SYSTEM

FIELD OF THE INVENTION

This invention pertains to tooth assemblies for replaceable digging teeth on digging and excavating machinery.

BACKGROUND OF THE INVENTION

Various types of earth-moving and excavating machinery are equipped with digging buckets (having digging teeth facing toward the machine) or dippers (having teeth facing away from the machine), including front end loaders, back hoes, hydraulic excavators, mining shovels and the like. The digging buckets typically have several teeth to enhance material removal. Since the primary wear areas on the buckets are the bucket lip and the teeth, many buckets have replaceable teeth and lip shrouds.

In a typical replaceable-tooth assembly a tooth point with a hollowed-out rearward portion forming a socket is fitted over the nose of an adaptor attached to the bucket or the lip shroud. In a typical assembly the tooth point socket is removably secured to the adaptor by a pin extending through aligned openings in the adaptor and tooth point. To secure the assembly, the locking pin is usually retained by a pin or ring that interengages with a notch or slot in the pin.

Some prior designs have used a locking pin extending vertically through the tooth point. However, in such designs, the heads of the pin are exposed to the main body of earth going into the bucket and to the earth below so that rocks often hit the heads of the pin causing deformation and dirt wedges between the pin and the receiving hole. Consequently, the pin is difficult to remove and much time is required to replace such tooth points.

In other designs the locking pin has been disposed horizontally, but the removal of the locking pin has in many cases been difficult because of the force required to extract the pin or its keeper and the limited space between teeth, which inhibits access and the application of force.

SUMMARY OF THE INVENTION

It is therefore an object of the invention to provide a tooth and lock assembly that requires very little force to assemble or disassemble, but which securely locks a tooth to the adapter.

According to an illustrated embodiment of the invention, a lock system for locking a tooth point to an adapter adapted to be mounted on earth moving equipment is provided comprising a locking pin, and a keeper. The adaptor has a nose portion having a hole extending through it. The tooth has a socket adapted to cooperatively receive the nose portion of the adapter. The tooth point has a first and a second aperture in opposite side walls that are coaxial with the adaptor hole when assembled. The first aperture comprises a counterbored hole with an undercut annular groove. The second aperture comprises an internal bore with a reduced diameter section at its outer face. A locking pin is situated in the adaptor hole and the first and second apertures of the tooth point, fixing the tooth point to the adaptor. The diameter of the locking pin is preferably slightly less than the nominal diameter of the apertures and hole, and greater than the diameter of the reduced diameter section of the second aperture. A keeper, comprising a ring having a rigid inner core and a resilient outer rim, is situated in the annular groove so as to retain the locking pin. A diameter of the keeper is greater than the diameter of the first aperture counterbore. The inner core of the keeper defines a hole that is sized so that it will not let the locking pin pass through it. The hole permits the keeper to be easily removed with a prying tool.

According to a preferred embodiment of the invention, the annular groove in the first aperture is frusto conical with the smaller diameter toward the adjacent outer surface of the tooth. The locking pin has a tapered nose, and the reduced diameter section of the second aperture comprises a tapered wall that is sized cooperatively to receive the tapered nose of the locking pin. The keeper is preferably somewhat oblong in shape, having a reduced width, so that it may more easily pass through the counterbore of the first aperture. The keeper preferably has a rounded edge on at least one side of its outer rim to facilitate its insertion through the counterbore.

Assembly of the tooth and adaptor is accomplished by disposing the tooth point socket over the adaptor nose so that the apertures in the tooth point and the adaptor hole register, and then inserting the pin through the registered apertures and hole. The keeper is then situated in the annular groove by pushing it through the counterbore, preferably at a tilted angle, so that the outer rim deforms to allow passage through the counterbore. The keeper retains the locking pin in locking position. Removal of the keeper is accomplished by prying it out of the annular groove with a prying tool such as a screw driver. The locking pin can usually easily be pushed out from its opposite end or driven out with a drift pin if dirt or foreign material causes it to bind.

The foregoing and additional features and advantages of the invention will be more readily apparent from the following detailed description, which proceeds with reference to the accompanying drawings.

DETAILED DESCRIPTION

Figure 1:
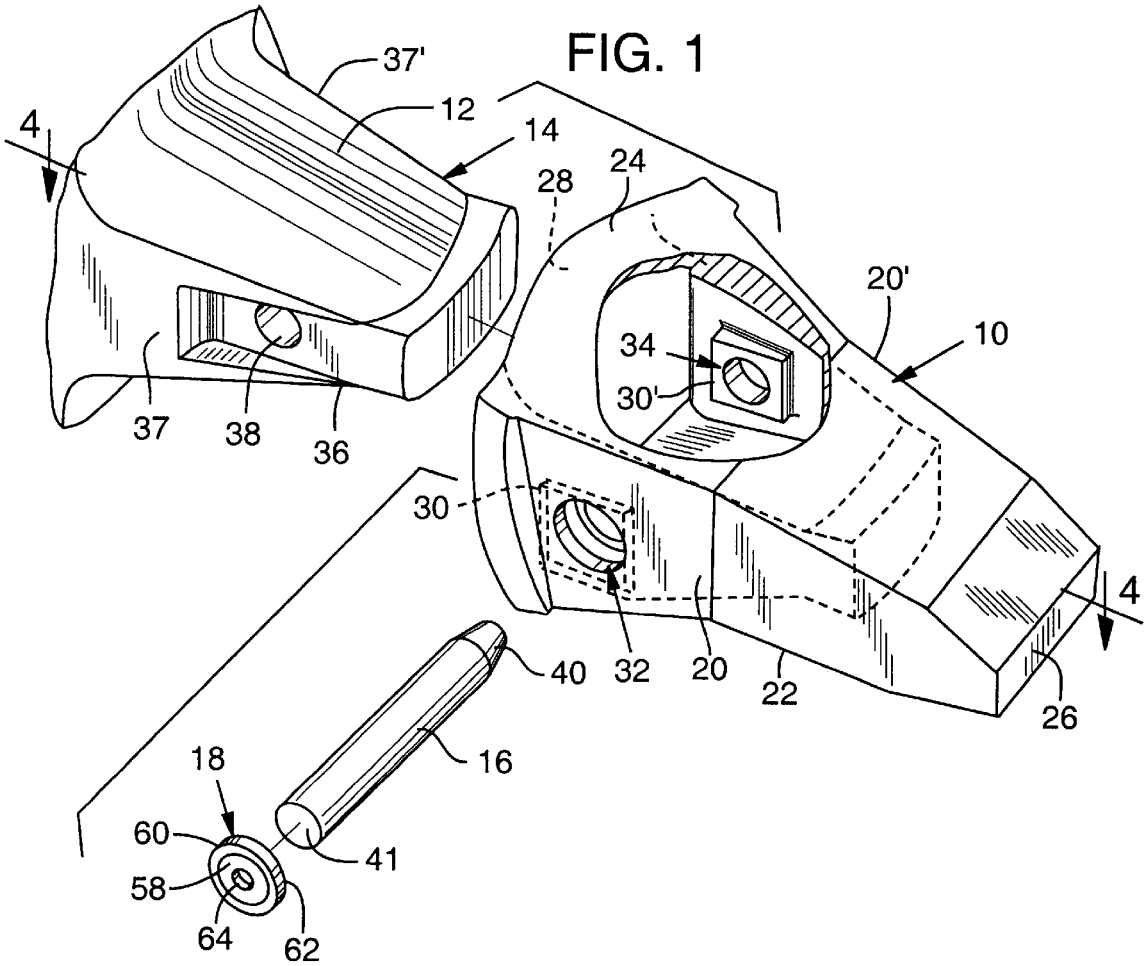
FIG. 1 is an exploded perspective view of a tooth assembly, partly broken away showing a preferred embodiment of the invention.

A preferred embodiment of the invention as illustrated in FIG. 1 comprises a tooth point 10 mounted on the nose 12 of an adaptor 14. The tooth point 10 is removably secured to the adaptor 14 by a locking pin 16 held in place by a keeper 18. As will be understood, a plurality of adapters will be mounted at regular intervals on the forward edge of the bottom of an excavating shovel or like earth moving apparatus.

Referring still to FIG. 1, the tooth point 10 has opposite side walls 20, 20', a bottom wall 22, and a top wall 24. The top wall 24 and the bottom wall 22 meet to form a horizontal front cutting edge 26 and diverge rearwardly to form a rear-facing socket 28. The side walls 20, 20' comprise inward facing bosses 30, 30' through which and the side walls extend co-axial apertures 32, 34, respectively.

The adaptor nose 12 is shaped to fit cooperatively in the socket 28 in the tooth point 10, and is formed with recesses or slots 36, 36' in its opposing side surface 37, 37', respectively, adapted to receive the bosses 30, 30' of the tooth point 10 when the latter is mounted upon the adaptor 14.

A hole 38, centrally located with the recesses 36, 36' and preferably cylindrical in shape and adapted to cooperatively receive the locking pin 16, extends horizontally through the adaptor nose 12, such that it is coaxial with the apertures 32, 34 when the tooth point 10 is mounted on the adaptor nose 12.

Figure 4:
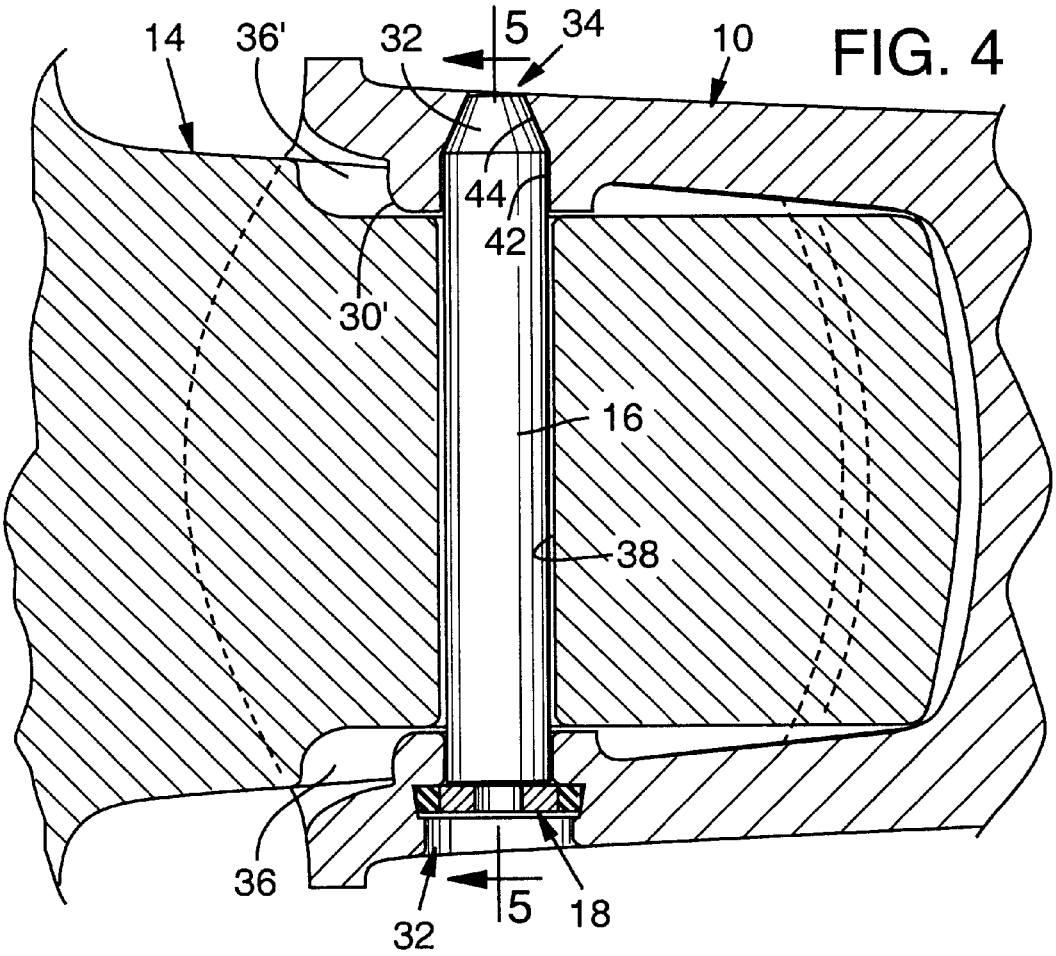
FIG. 4 is an enlarged cross-sectional view taken along line 4—4 of FIG. 1 of an assembled tooth adaptor and locking pin.
Figure 5:
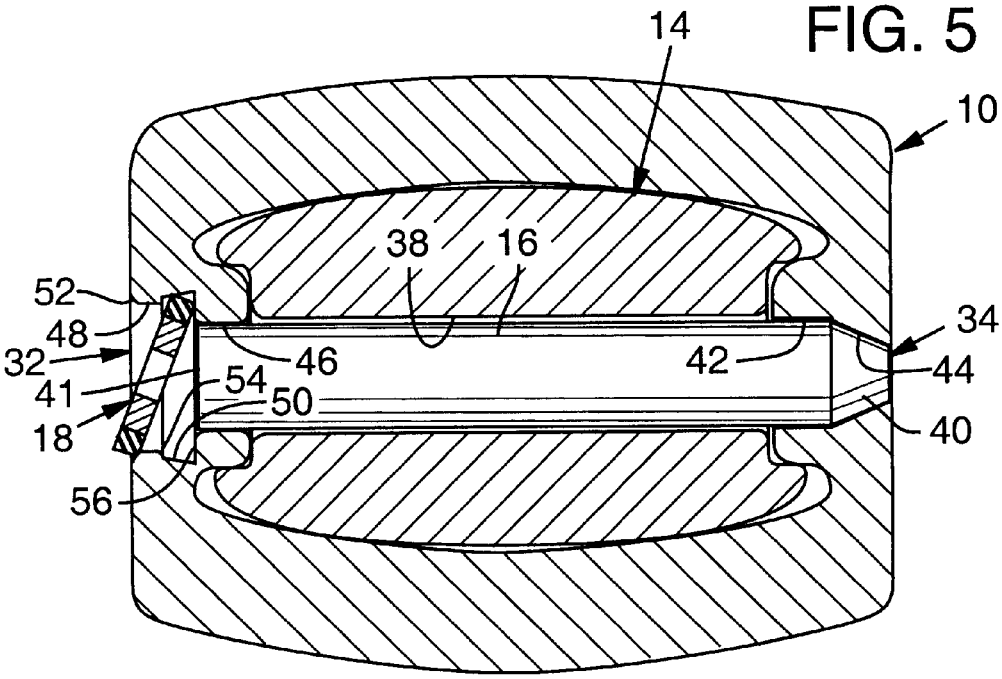
FIG. 5 is a cross-sectional view taken along line 5—5 of FIG. 4.

Referring to FIGS. 4 and 5, the locking pin 16 and hole 38 are sized so that the pin fits snugly, but not tightly within the hole 38. The locking pin 16 is preferably cylindrical with a tapered nose 40 at one end, the head end 41 preferably being flat and perpendicular to the pin axis. The aperture 34 comprises two sections, an inner section 42 and an outer section 44. The inner section 42 is of an uniform diameter slightly greater than the diameter of the cylindrical portion of the pin 16. The outer section 44 of the aperture tapers inwardly toward the outer surface of the side wall 20' at substantially the same angle as the taper on the pin nose 40, as may be seen in FIGS. 4 and 5. The pin 16 is preferably configured so that the axial length of the tapered nose 40 is no greater than the axial length of the tapered section 44 of the receiving bore so that the pin will not protrude outwardly of the tooth. The aperture 32 comprises a pin receiving section 46, a counterbore 48, and an annular groove 50 positioned between the section 46 and counterbore 48. The outer edge 52 of the counterbore 48 is preferably rounded as shown. The annular groove 50 is undercut into the counterbore 48, forming an outer shoulder 54 and inner shoulder 56. Additionally, the annular groove 50 is frusto conical so that its diameter increases with depth.

As shown in FIGS. 4 and 5, when the locking pin 16 is in its installed position the head end 41 of the locking pin 16 is confined within the pin receiving section 46 and preferably does not extend into the groove 50.

Figure 2:
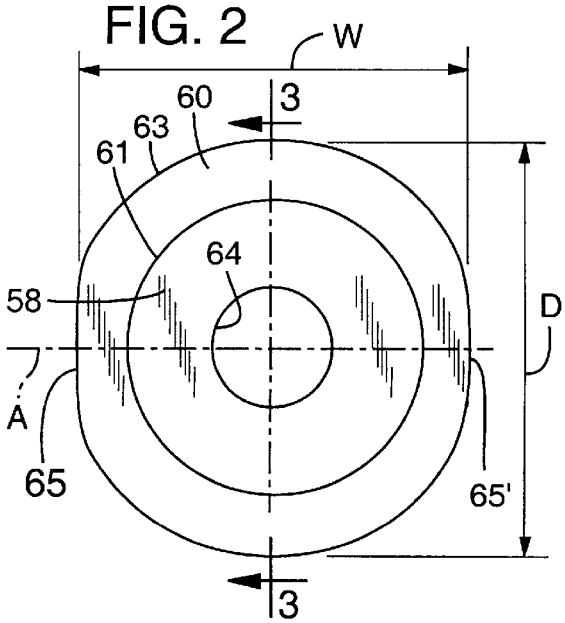
FIG. 2 is an enlarged plan view of a keeper ring.
Figure 3:
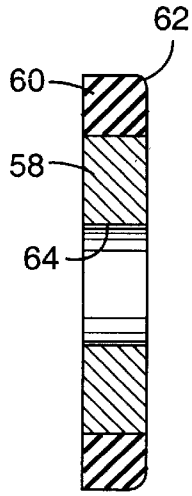
FIG. 3 is a sectional view of the keeper taken along line 3—3 of FIG. 2.

As illustrated in FIGS. 2 and 3, the keeper 18 comprises a ring-like rigid, metal core 58 and an outer rim 60. The outer rim 60 is made from a resilient material such as rubber or another suitable elastomer bonded to the inner core 58. A radius 62 provides a rounded outer edge of the outer rim 60. The inner surface 61 of the rim 60 is circular and sized so that it snugly engages the outer surface of the core 58 and can be firmly bonded thereto. The outer surface 63 of the rim 60 may be circular, but preferably, as shown in FIG. 2, is of reduced radial thickness at opposite portions 65, 65' than the thickness of the remainder of the ring so that the ring is somewhat oblong in shape. This reduction in width can be obtained by grinding or otherwise removing material from the opposite portions 65, 65' of a circular ring, to provide a ring width W, which is of the order of 1.625 inches in a ring having a nominal diameter D of 1.750 inches. The inner core 58 is formed with a central hole 64, which can be cylindrical or slotted, sized so that the keeper 18 can be engaged with a screwdriver or similar tool to pry it out, while not being large enough to let the locking pin 16 pass through it. The nominal diameter D of the keeper 18 is greater than the diameter of the counterbore 48 and is preferably substantially equal to the maximum diameter of the groove 50.

During assembly the tooth point 10 is positioned on the adaptor 14 and the locking pin 16 is inserted through the apertures 32, 38, 34, into the position illustrated in FIGS. 4 and 5. After the locking pin 16 is inserted, the keeper 18 is placed into the annular groove 50, as follows. The keeper 18 is positioned so that the rounded edge side will enter first, the curved surface facilitating its entry. As shown in FIG. 5, the keeper 18 is tilted about its A axis (FIG. 2) so that one side of the outer rim 60 extends into in the annular groove 50. The frusto-conical shape of the groove 50 also facilitates the entry of the keeper 18. The other side of the keeper 18 is then pushed through the counterbore 48 so that the keeper 18 is fully situated in the annular groove 50, as shown in FIG. 4. The configurations of the rim 60 with the lessened wall thickness at the portions 65, 65' facilitates the distortion of the rim as it is pushed through the counterbore 48. When inserted keeper 18 is held in place by the shoulders 54, 56. Once in place, the keeper ring 18 secures the locking pin 16.

To remove the locking pin 16 the keeper 18 is first removed by prying it out with a screwdriver or similar prying tool. The locking pin 16 can then be easily removed by pushing it out from the opening 34 with a drift pin or similar tool. While the keeper 18 may be easily installed and removed, it remains in place while the equipment is in use because it is not exposed to external forces.

The tooth point 10 and the adaptor 14 are preferably made of an alloy steel, and can be formed by any suitable metal-forming process, including casting and/or machining. The locking pin 16 is preferably made from a heat-treated steel.

Although the invention is described herein with reference to the preferred embodiment, it will be apparent to one skilled in the art that the invention permits of modification in arrangement and detail. For example, while the invention is illustrated with horizontally disposed apertures, hole, and locking pin, the invention may also be utilized with vertical disposition of the apertures, hole, and locking pin. We claim all modifications as come within the spirit and scope of the appended claims.

We claim:

1. A lock system for locking a tooth point to an adaptor adapted to be mounted on earth moving equipment, comprising an adaptor having opposite top and bottom surfaces and opposite side surfaces, and a circular adaptor hole of predetermined diameter extending through the adaptor between a pair of said opposite surfaces;

a tooth point having a socket cooperatively receiving said adaptor defined by top, bottom and opposite side walls each having an inner face and an outer face, said adaptor hole being overlapped by a pair of opposite walls of said tooth point, said pair of opposite walls having a first and a second aperture, respectively, therein axially aligned with said hole, said first aperture being of circular cross section and comprising a portion opening to the inner face of the wall containing said first aperture and being substantially the same diameter as said adaptor hole diameter, said first aperture comprising a counterbored portion of a predetermined diameter greater than said adaptor hole diameter, said counterbored portion being adjacent the said outer face of the wall containing said first aperture and having an annular groove therein, said second aperture comprising an internal bore having a first section opening to the inner face of the wall containing said second aperture and a second section of a diameter less than that of said adaptor hole adjacent its said outer face;

a locking pin of circular cross-section situated in said adaptor hole and first and second apertures and fixing the tooth point to the adaptor, said locking pin having a diameter larger than the reduced diameter section of said second aperture; and a ring-shaped keeper, having a rigid inner core and a resilient outer rim portion, said inner core defining a circular hole substantially coaxial with said locking pin and sized to prevent the locking pin from passing therethrough, said outer rim portion having a chord across the axis of said inner core hole greater than the diameter of said counterbored portion of said first aperture, said keeper being situated within said annular groove when assembled so as to retain said locking pin in said adaptor hole and said apertures.

2. The lock system of claim 1 wherein the adapter has a forward-extending nose.

3. The lock system of claim 1, wherein said annular grove is frusto conical.

4. The lock system of claim 1, wherein the outer rim of the keeper is oblong in shape.

5. The lock system of claim 1, wherein said keeper has opposite, parallel, flat side surfaces and said outer rim portion has a peripheral surface extending perpendicularly to said side surfaces and defining with said side surfaces opposite outer edges, one of said outer edges being rounded.

6. The lock system of claim 1, wherein said locking pin has a nose that is tapered, and the reduced section of said second aperture is tapered so as cooperatively to receive said nose.

7. A lock system for locking a replaceable earth-engaging member to a driving member, comprising a driving member adapted to be moved in a predetermined direction for forcibly driving an earth-engaging member, the driving member having a circular hole extending therethrough perpendicular to said direction;

an earth-engaging member mounted on said driving member, said earth-engaging member having a socket defining opposing first and second side walls, said opposing first and second side walls defining a first and a second aperture, respectively, axially aligned with said driving member hole, said first aperture comprising a circular counterbored portion with an undercut annular groove therein, said second side wall having an outer face, said second aperture comprising an internal bore having a first section of a diameter substantially equal to the diameter of said driving member hole and a second section of a diameter less than the diameter of said driving member hole adjacent said outer face of said second side wall;

a locking pin of circular cross section situated in said driving member hole and first and second apertures and fixing the earth-engaging member to the driving member, said locking pin having a first portion of a diameter larger than the reduced diameter section of said second aperture; and a keeper having a rigid inner core and a resilient outer rim, said inner core defining a circular center hole coaxial with said locking pin that will not allow the locking pin to pass therethrough, said outer rim having a diameter across the axis of said center hole greater than the diameter of the counterbored hole of said first aperture, said keeper being situated within said annular groove when assembled so as to secure said locking pin within said driving member hole and said first and second apertures, but removable from said groove to permit withdrawal of said locking pin from said driving member and said earth-engaging member to permit removal of said earth-engaging member from said driving member.

8. The lock system of claim 7 wherein said driving member is an adapter which is adapted to be fixedly connected to an excavating bucket.

9. The lock system of claim 7 wherein the earth-engaging member is a tooth point comprising sloped top and bottom walls and vertical side walls, the top and bottom walls meeting to form a front-facing cutting edge and diverging rearwardly to form a rear-facing socket.

10. A lock system for locking a tooth point to an adaptor adapted to be mounted on earth moving equipment, comprising an adaptor having opposite top and bottom surfaces and opposite side surfaces, and an adaptor hole extending through the adaptor between said opposite side surfaces, said adaptor having a forward-extending nose;

a tooth point having a rear-facing socket defined by top, bottom and opposite first and second side walls, cooperatively receiving said forward-extending adaptor nose, said first and second side walls each having an inner face and an outer face, said adaptor hole being overlapped by said opposite first and second side walls of said tooth point, said first side wall having a first aperture therein of frusto-conical configuration, said first aperture being axially aligned with said adaptor hole and converging toward said outer face of said first side wall, said second side wall having a second aperture therein including a first portion of circular cross section adjacent the said inner face of said second sidewall, a second portion adjacent the said outer face of said second sidewall, said second portion being of a circular cross section of greater diameter than said first portion, and a third portion intermediate said first and second portions, said third portion being of frusto-conical configuration, and being of greater diameter throughout than said second portion and converging toward said second portion;

a cylindrical locking pin positioned in said adaptor hole and having a first end extending into said first aperture, said locking pin first end being tapered and being cooperatively received in said first aperture, said locking pin having, opposite said first end, a second end cooperatively received in said second aperture first portion; and a keeper, having a rigid, annular inner core portion having a circular periphery and a resilient outer rim portion, said inner core portion being of lesser outer diameter than said second aperture second portion, said inner core portion having a hole therethrough with a dimension that will not allow the locking pin to pass therethrough, the periphery of said outer rim portion being oblong in shape and having a chord across the axis of said circular periphery greater than the diameter of said second aperture second portion, said keeper being positioned within said second aperture third portion to retain said locking pin within said adaptor hole and said tooth point first and second apertures.

* * * * *